US006346916B1

(12) United States Patent
Odachi et al.

(10) Patent No.: US 6,346,916 B1
(45) Date of Patent: Feb. 12, 2002

(54) ANTENNA APPARATUS AND RADIO DEVICE USING ANTENNA APPARATUS

(75) Inventors: Noriaki Odachi; Syuichi Sekine, both of Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/512,824

(22) Filed: Feb. 25, 2000

(30) Foreign Application Priority Data

Feb. 26, 1999 (JP) ..... 11-051462

(51) Int. Cl.[7] ..... H01Q 1/24; H01Q 1/38
(52) U.S. Cl. ..... 343/702; 343/821
(58) Field of Search ..... 343/702, 895, 343/793, 796, 820, 821, 822, 795, 846, 700 MS, 829, 830, 725, 785

(56) References Cited

U.S. PATENT DOCUMENTS

| | | | | |
|---|---|---|---|---|
| 2,167,709 A | | 8/1939 | Cork et al. | |
| 4,205,317 A | | 5/1980 | Young | 343/720 |
| 4,504,834 A | * | 3/1985 | Garay et al. | 343/749 |
| 5,517,676 A | * | 5/1996 | Sekine et al. | 455/89 |
| 5,532,708 A | | 7/1996 | Krenz et al. | 343/795 |
| 5,563,615 A | * | 10/1996 | Tay et al. | 343/749 |
| 5,598,174 A | * | 1/1997 | Erkocevic et al. | 343/795 |
| 5,926,140 A | | 7/1999 | Yokoyama | |
| 5,949,383 A | | 9/1999 | Hayes et al. | |
| 6,147,647 A | * | 11/2000 | Tassoudji et al. | 343/700 MS |
| 6,147,653 A | * | 11/2000 | Wallace et al. | 343/702 |

FOREIGN PATENT DOCUMENTS

| | | |
|---|---|---|
| WO | WO 96/37007 | 11/1996 |

* cited by examiner

*Primary Examiner*—Don Wong
*Assistant Examiner*—Chuc Tran
(74) *Attorney, Agent, or Firm*—Oblon, Spivak, McClelland, Maier & Neustadt, P.C.

(57) ABSTRACT

Antenna apparatus is comprised of dipole antenna arranged proximate to a surface of metal housing including radio device circuit and having two quarter wavelength elements having opposite end portions being feed points, short-circuit element short-circuiting the quarter wavelength elements, and coaxial feed line having outer conductor and central conductor having one ends connected to the feed points, respectively, and connecting the feed points to radio device circuit. The coaxial feed line is arranged along part of the quarter wavelength element and part of the short-circuit element and branched from central portion of the short-circuit element. The outer conductor is electrically connected to part of the quarter wavelength element and part of the short-circuit element. Currents leaked onto the feed line and flowing through the two quarter wavelength elements are also divided to the short-circuit element. The currents are mixed at a position at which the coaxial feed line is branched and flow into the outer conductor of the coaxial feed line as a leak current from the dipole antenna. The currents branched from the two quarter wavelength elements to the short-circuit element are almost opposite in phase to each other. Thus, the currents cancel each other and the leak current becomes zero.

20 Claims, 11 Drawing Sheets

5[dB/div]
— V POLARIZED WAVE
--- H POLARIZED WAVE

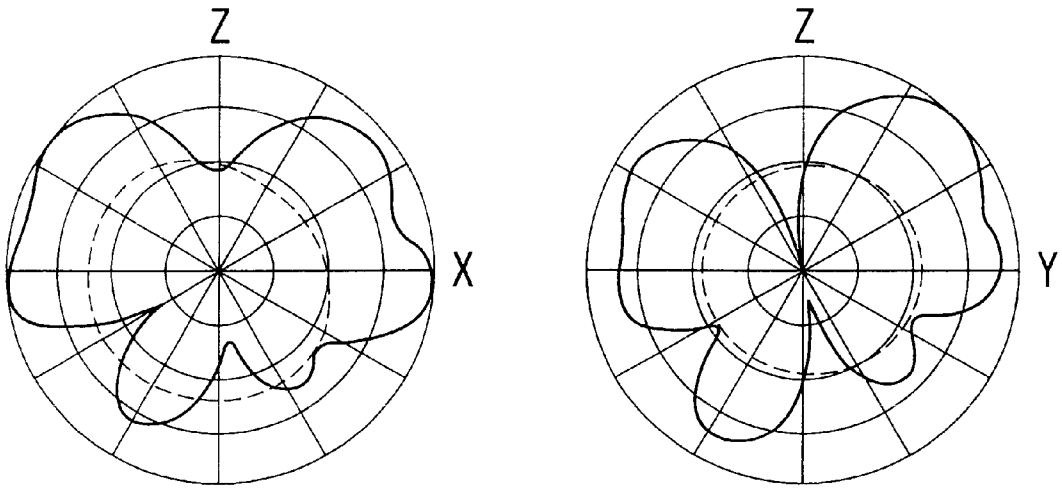
FIG. 10A
PRIOR ART
FIG. 10B
PRIOR ART
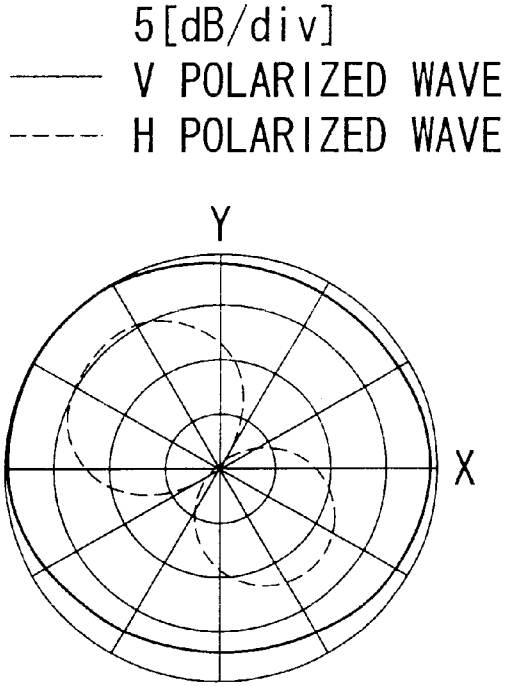
FIG. 10C
PRIOR ART

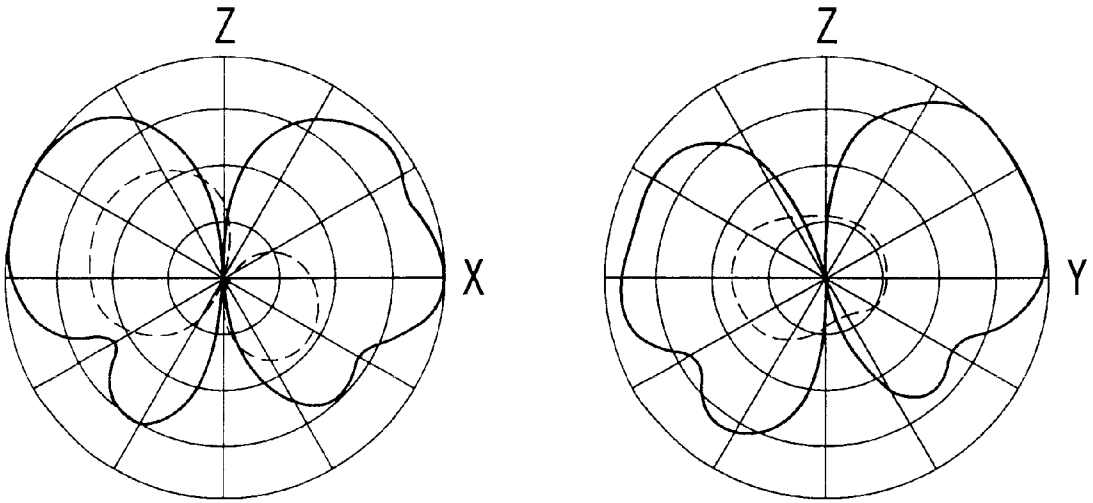
FIG. 17A
FIG. 17B
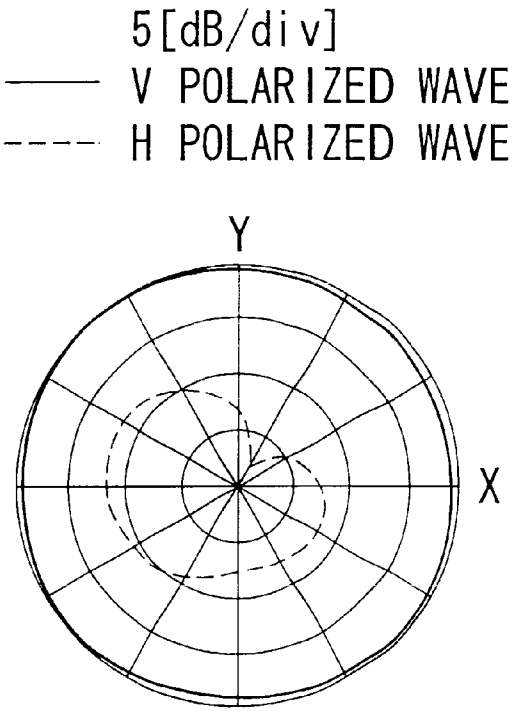
FIG. 17C

RADIATION FIELD A∝i1'-i2''

RADIATION FIELD B∝i1'+i2''
A<B

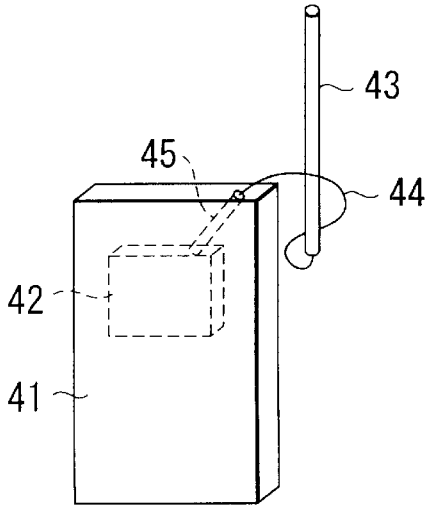
FIG. 21
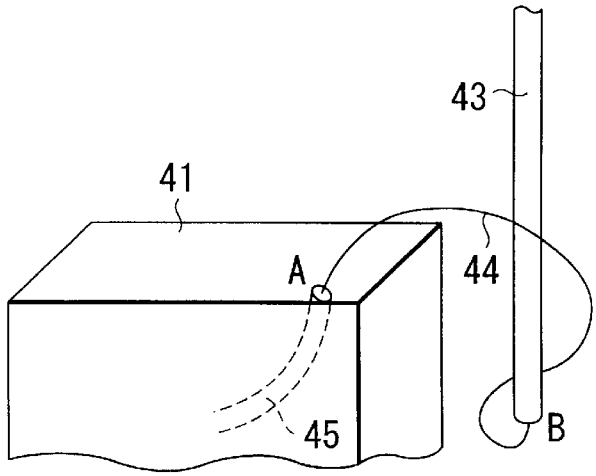
FIG. 22
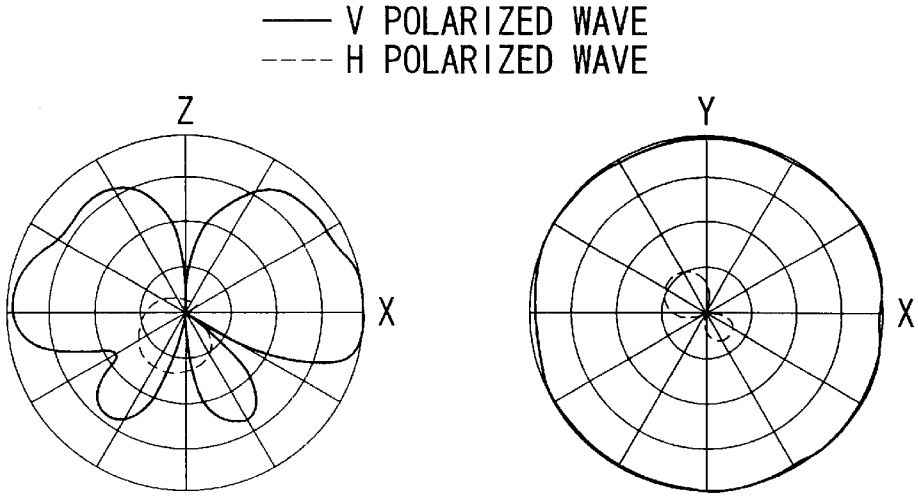
FIG. 23A
FIG. 23B
FIG. 24
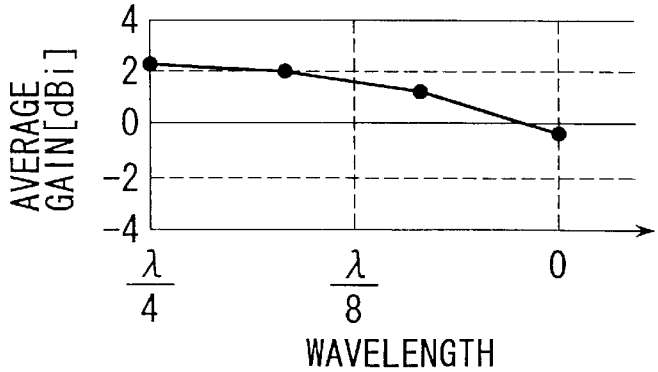

ANTENNA APPARATUS AND RADIO DEVICE USING ANTENNA APPARATUS

CROSS-REFERENCE TO RELATED APPLICATIONS

This application is based upon and claims the benefit of priority from the prior Japanese Patent Application No. 11-051462, filed Feb. 26, 1999, the entire contents of which are incorporated herein by reference.

BACKGROUND OF THE INVENTION

The present invention relates to an antenna apparatus mainly used for a portable radio device and a radio device using the same.

A portable radio device, such as a portable telephone, a PHS terminal and a small radio base station, is often integral with an antenna (or a feed point is proximate to a housing). It is required to include an antenna in a main body of a radio device such as a plastic cover to prevent breakdown when the antenna of a portable telephone or a PHS terminal falls or to resist breakdown due to weather in case of the antenna at the radio base station.

Conventionally, an inverted F-type antenna is often used as one included in a portable radio device. FIG. 1 shows the configuration of a portable radio device employing a conventional inverted F-type antenna. An inverted F-type antenna 103 is disposed (protruded) on a metal housing 101 which includes a radio device circuit 102 consisting of a radio circuit and a signal processing circuit, and which also serves as a shield. The metal housing 101 is disposed in a plastic cover which is not shown in FIG. 1. A feed point 103*a* is provided at the metal housing 101. As can be seen in this example, the inverted F-type antenna 103 is low profile and small in size. It has an advantage in that good radiation characteristics can be obtained despite its proximity to the housing 101.

Normally, the performance of the built-in antenna itself tends to deteriorate since the antenna is required to be smaller in size and thinner. As shown in FIG. 1, if the inverted F-type antenna 103 is employed, the metal housing 101 is used as part of the antenna, thereby making it possible to compensate for the deterioration of the antenna performance and to, therefore, enhance it.

In this way, while the inverted F-type antenna 103 is good in antenna performance, it has a disadvantage in that it tends to receive high frequency noise leaked from the radio circuit section or the signal processing circuit of the radio device circuit 102. It is actually difficult to completely shield the radio device circuit 102 with the metal housing 101 with the configuration shown in FIG. 1 and leaked noise inevitably exists on the housing 101. Besides, because of employing the metal housing 101 as part of the antenna in case of FIG. 1, the leaked noise is directly received by the inverted F-type antenna 103, resulting in the great deterioration of communication quality. In recent years, in particular, the processing speed of the signal processing circuit increases and the difference between the radio communication frequency and the frequency of the leaked noise decreases, so that the deterioration of the communication quality due to the leaked noise from the signal processing circuit causes a grave problem.

To decrease such an influence of the leaked noise, there is proposed employing a dipole antenna 104 for a portable radio device as shown in FIG. 2. As already known, the dipole antenna does not need a ground. It is, therefore, unnecessary to directly connect the dipole antenna 104 to the metal housing 101 serving as a ground. Owing to this, even if leaked noise exists on the metal housing 101, it is possible to prevent the noise from directly flowing into the dipole antenna 104.

Nevertheless, even with the dipole antenna, a problem inevitably arises if it is practically used as an antenna built in a portable radio device. If the dipole antenna is included in the plastic cover of the portable radio device, the antenna is disposed proximate to the metal housing 101, thereby disadvantageously deteriorating antenna performance. Generally, the dipole antenna exhibits best performance when arranged in a free space where nothing is present around the antenna. Thus, if the metal housing 101 is provided near the antenna, the antenna performance deteriorates. This is because the radiation power of the antenna decreases, i.e., matching loss occurs if the dipole antenna 104 is put closer to the metal housing 101.

FIG. 3 shows the calculation results of the matching loss of the dipole antenna made by the inventors of the present invention. In FIG. 3, the horizontal axis indicates a state in which an antenna is put and the vertical axis indicates matching loss. The matching loss is one which is generated when a feed line does not match with the antenna in impedance. If so, radiation power from the antenna decreases and communication quality deteriorates. FIG. 3 shows calculation results of a case where the dipole antenna exists in a free space without a metal housing and a case where a metal housing is provided in the vicinity of the dipole antenna. If the dipole antenna exists in a free space, matching loss is as small as 0.2 dB and the antenna exhibits excellent characteristic. If the metal housing is provided in the vicinity of the dipole antenna, the matching loss increases to about 8.5 dB and the antenna characteristic clearly, greatly deteriorates.

Measures to improve the input characteristics of such a dipole antenna were already taken and an antenna known as a T-matching antenna was contrived (see "Antenna Engineering Handbook", The Institute of Electronics, Information and Communication Engineers edition, pp. 114–115, 1980). FIG. 4 shows a T-matching antenna. The T-matching antenna has a structure in which a short-circuit element 113 which causes a shortcircuit between quarter wavelength elements 111 and 112 is added to a dipole antenna 110 consisting of the two quarter wavelength element 111 and 112. The short-circuit element 113 functions as an antenna impedance matching element, whereby even if the dipole antenna 110 is disposed proximate to the metal housing 101 as shown in FIG. 5, good antenna characteristics can be obtained.

The right of FIG. 3 shows matching loss if the dipole antenna which has been T-matched as stated above in the vicinity of the metal housing. Although there is a metal housing in the vicinity of the antenna, the matching loss is as small as 0.5 dB and the antenna exhibits good characteristics.

The above consideration has been given to the characteristics of the dipole antenna which has been T-matched without regard to the influence of a feed line connecting the antenna to a radio device circuit. Actually, however, it is necessary to take account of the presence of the feed line. If the feed line exists, leaked noise is transferred from the radio device circuit to the feed line and finally to the antenna, possibly damaging communication quality. To prevent this, there is proposed a ferrite core for connecting a personal computer (PC) to a display. The ferrite core has, however, relatively high capacity and is not suited to be used as the feed line of a built-in antenna.

To prevent leaked noise from being transferred from the radio device circuit to the antenna without using such a ferrite core, there is proposed arranging the dipole antenna 110 which has been T-matched in the vicinity of the metal housing 101, pulling out a feed line 114 from the surface of the metal housing 101 and putting the feed line 114 in parallel to the metal housing 101 in an electrically non-contact state as shown in FIG. 5.

Upon so constituted, if the length of the feed line 114 which has been branched from the metal housing 101 is set at a quarter wavelength, two short-circuit parallel lines are formed by the feed line 114 on the metal housing 101 and the image of the feed line 114 as shown in FIG. 5. The impedance of the two short-circuit parallel lines of a quarter wavelength viewed from a feed point is quite high. Thus, even if the current of the leaked noise flows on the feed line (particularly on the outer conductor of a coaxial feed line), the leaked noise current is cut off at a high impedance portion and not transferred to the antenna.

In this method, the length of the feed line is limited to a quarter wavelength. Normally, the degree of freedom of the length of a feed line is not necessarily ensured. In practice, the radio device circuit of a portable radio device includes not only a radio circuit section but also a signal processing circuit, an information processing circuit, a power circuit and an external interface section. In consideration of the overall optimal layout of these elements, the length of the feed line cannot be always optimized. In that respect, the above-stated method is not universal.

The inventors of the present invention calculated the magnitude of a current leaked from an antenna to a feed line when a current is fed to the feed line of the antenna to turn the antenna into a transmission state so as to evaluate the deterioration of antenna characteristic with respect to noise if the length of the part of the feed line coupling the antenna to a radio device circuit which part branched on the surface of a metal housing is changed. This is equivalent to an evaluation as to whether noise leaked from the metal housing onto the feed line flows into the antenna in a reception state.

If the current leaked from the antenna to the feed line is low during transmission, it means that the electromagnetic coupling between feed point of the antenna and each point on the feed line is weak. This indicates that even if the current of the leaked noise is spread on the feed line during reception, the noise has a smaller influence on the current at the feed point.

FIG. 6 is a graph with a horizontal axis indicating the length of a feed line and a vertical axis indicating a maximum current value on the feed line normalized by a maximum current value on the antenna. If the length of the feed line is a quarter wavelength, the maximum current on the feed line is minimum (about −25 dB). If the length of the feed line is not a quarter wavelength, the current of the feed line increases up to 10 dB. As is obvious from this result, the influence of the leaked noise greatly varies with the length of the feed line.

In the above method, description has been given to the influence of leaked noise on the feed line while taking the dipole antenna positioned in the vicinity of the metal housing as an example. Now, the influence on the housing will be described while taking a monopole antenna arranged on a metal housing as an example.

A helical antenna is constituted by coiling the linear element of a monopole antenna to thereby make the antenna small in size. The helical antenna is used for a PHS terminal. FIGS. 7A and 7B show the radiation patterns of a radio device model employing this helical antenna. Specifically, FIG. 7A shows the radiation pattern of the radio device model on a vertical plane (XZ plane) to the ground. FIG. 7B shows the radiation pattern thereof on a horizontal plane (XY plane) to the ground. Also, FIG. 7C shows the radio device model.

As shown in FIG. 7A, the radiation pattern on the vertical plane has peaks at −45° and +30° with respect to the horizontal direction (X direction). The radiation pattern on the horizontal plane shown in FIG. 7B is closer to an omni-directional shape but the pattern level is low. Due to this, it is not suited for establishing good communication. The reason for these radiation patterns is that the portable radio device has radiation not only from the antenna but also from a high frequency current leaked into the metal housing.

If the length of the metal housing in the direction of the Z axis is longer than a half wavelength, the phase difference between the high frequency current on the antenna and that on the metal housing is reversed and radiations in the horizontal plane cancel one another. In this way, the radiation characteristics of the antenna is changed by the radiation from the metal housing and the level in the horizontal plane becomes particularly low.

To prevent the above-stated deterioration and to improve gain in the horizontal plane, there is known a method employing a dipole antenna as already described above. There are also known other methods for increasing radiation from the antenna.

The helical antenna is formed by helically winding a linear element of about a quarter wavelength. Due to this, the actual dimension of the helical antenna in a longitudinal direction is about a tenth wavelength and the radiation quantity of the antenna is quite small. Thus, the radiation from the metal housing of the radio device is superior to that of the antenna itself, with the result that the radiation characteristics of the antenna is increasingly deteriorated by the metal housing as already stated above.

To prevent this, there is proposed a method of increasing radiation from the antenna by connecting a linear element of a half wavelength to the tip end of the helical antenna. If so, the overall length of the antenna is the sum of the length of the helical antenna and that of the half wavelength element. The antenna is, therefore, longer in practice and the radiation quantity of the antenna increases. Furthermore, since the half wavelength element is connected to the helical antenna, good matching is ensured between a feed line and the antenna as in the case of employing only a helical antenna.

FIGS. 8A and 8B show radiation patterns in a case where the half wavelength element is connected to the tip end of the helical antenna as stated above. As in the case of FIGS. 7A and 7B, FIG. 8A shows a radiation pattern on a vertical plane (XZ plane) to the ground, FIG. 8B shows a radiation pattern on a horizontal plane (XY plane) to the ground. FIG. 8C shows a radio device model. As is evident from the radiation pattern on the horizontal plan shown in FIG. 8B, the quantity of radiation increases on the horizontal plane, whereas the radiation pattern on the perpendicular plane shown in FIG. 8A has large increases at +30° and −50° with respect to the horizontal direction (X direction).

Namely, although this method can increase the quantity of radiation on the horizontal plane, the antenna is not optimum for establishing good communications since there are maximum radiations in directions other than the horizontal direction. The reason for these radiation patterns is that the helical antenna and the half wavelength element deteriorate mutual radiation. That is to say, the phase of the high frequency current on the helical antenna and that on the half wavelength element are opposite to each other and the radiation from the helical antenna and that from the half wavelength element cancel each other in the horizontal direction.

Meanwhile, in a portable radio device or the like, it is desired to make the antenna omni-directional. In that case, the influence of the feed line becomes increasingly large. FIG. 9 shows a specific example of an antenna intended to have directivity in the horizontal plane shown in FIG. 8C. The dipole antenna consists of a linear element 136 provided in proximity to the upper surface of a metal housing 131 including a radio device circuit 132 therein, a helical element 137, a half wavelength element 138 provided on the tip end of the helical element 137 and a coaxial feed line 133.

The coaxial feed line 133 connects the antenna to the radio device circuit 132. One end of an outer conductor 134 is connected to the first feed point which is one end of the linear element 136. One end of a central conductor 135 is connected to the second feed point which is one end of the helical element 137. The half wavelength element 138 is connected to the other end of the helical element 137.

In the antenna shown in FIG. 9, it is expected that the half wavelength element 138 serves as a main radiation source, whereby vertical polarized waves realizes an omni-directional radiation pattern in the horizontal plane. In that case, the helical element 137 has a smaller radiation quantity than the half wavelength element 137 and only functions as a matching circuit. The calculation results of the radiation patterns of the antenna in the ZX, ZY and YX planes are shown in FIGS. 10A, 10B and 10C, respectively. As can be seen from the results, the radiation pattern of the vertical polarized wave becomes omni-directional in the horizontal plane (XY plane) but generates ripple of not less than 2 dB.

In IMT 2000 system which is expected to be put to practical use as a communication system for portable radio devices in the near future, the antenna of a radio device as a terminal is required to be no-directional in the horizontal plane so as to realize high speed data communication and to prevent ripple of a directional pattern as much as possible. In the IMT 2000 terminal of this type, the occurrence of ripple shown in FIGS. 10A, 10B and 10C may possibly exceed an allowable limit. It is, therefore, necessary to further decrease ripple.

Now, the reason for the occurrence of the ripple will be described briefly. It is considered that ripple is generated by radiation from an unnecessary current leaked onto the surface of the outer conductor 134 of the coaxial feed line 133. As is obvious from FIGS. 10A, 10B and 10C, horizontal polarized waves, which are cross polarized waves, are generated in the respective radiation patterns on the ZX, ZY and YX planes, respectively. They are radiated from the outer conductor 134 of the coaxial feed line 133 parallel to the horizontal plane. In addition, the radiation pattern on the ZY plane shown in FIG. 10B is asynchronous about the vertical axis. This is also due to the distortion of the radiation pattern of the half wavelength element 138 by the radiation from the outer conductor 134 of the coaxial feed line 133.

As described above, in the antenna intended to be integral with the portable radio device or to be built in the radio device, it is difficult to constitute an antenna so as not to receive noise leaked from the radio device circuit. It is possible to decrease leaked noise reception quantity by employing a dipole antenna which has been T-matched and by optimizing the length of the feed line. If so, however, the length of the feed line has a smaller degree of freedom. This makes it disadvantageously difficult to ensure good communication quality while maintaining the degree of freedom of the length of the feed line and maintaining both antenna characteristics and oppression characteristics for oppressing the influence of leaked noise.

Moreover, in the dipole antenna which has one element formed into a helical element so as to make the radiation pattern in the horizontal plane omni-directional, ripple or distortion is disadvantageously generated in the radiation pattern of the antenna due to unnecessary radiation from the feed line to thereby deteriorate communication quality.

Furthermore, if the half wavelength element is attached to the tip end of the helical antenna which is a monopole antenna made smaller in size and integrated with the metal housing of a radio device, so as to improve gain in the horizontal plane, the increase of gain in the horizontal plane is disadvantageously limited due to the difference in phase between a current on the helical antenna and that on the half wavelength element.

BRIEF SUMMARY OF THE INVENTION

Accordingly, it is an object of the present invention to provide an antenna apparatus and a radio device using the antenna apparatus capable of decreasing the influence of noise leaked from a radio device circuit and unnecessary radiation from a feed line and obtaining good communication quality in a configuration in which the radio device is integral with an antenna.

A related object of the present invention is to provide an antenna apparatus and a radio device using the antenna apparatus capable of increasing gain in a horizontal plane and obtaining good communication quality in a configuration in which a radio device is integral with an antenna.

To attain the above objects, an antenna apparatus according to the present invention is comprised of a dipole antenna having first and second quarter wavelength elements provided linearly in proximity to the surface of a metal housing including a radio device circuit, opposite end portions of the first and second quarter wavelength elements serving as the first and second feed points, respectively; a short-circuit element short-circuiting the first and second quarter wavelength elements; and a coaxial feed line connecting the first and second feed points to the radio device circuit. The coaxial feed line is arranged so that currents flowing into the coaxial feed line from first and second feed points through parts of the first and second quarter wavelength elements and the short-circuit element are almost opposite in phase to each other.

More specifically, the coaxial feed line has an outer conductor having one end connected to the first feed point and a central conductor having one end connected to the second feed point. The outer conductor is arranged along part of the first quarter wavelength element and the short-circuit element, and branched from the middle position of the dipole antenna of the short-circuit element in the longitudinal direction thereof. The outer conductor is electrically connected to part of the first quarter wavelength element and the short-circuit element.

In the antenna apparatus configured as stated above, currents flowing from the two feed points into the two quarter wavelength elements of the dipole antenna, respectively, are divided from the connection point with the short-circuit element to the quarter wavelength elements and the short-circuit element. The currents flowing into the short-circuit element are composed at a position at which the coaxial feed line is branched and flow into the outer conductor of the coaxial feed line as a leak current. Since the currents flowing into the short-circuit element through the two quarter wavelength elements, respectively, are almost opposite in phase to each other, a leak current on the outer conductor of the coaxial feed line becomes almost zero. Thus, the influence of the leaked noise from the radio device circuit is extremely improved and good communication quality can be realized, compared with the conventional antenna apparatus.

Another antenna apparatus according to the present invention is comprised of a dipole antenna having first and second quarter wavelength elements provided linearly in proximity to the surface of a metal housing including a radio device circuit; a short-circuit element short-circuiting the first and second quarter wavelength elements and divided into first and second segments, end portions of the first and second segments serving as the first and second feed points, respectively; and a coaxial feed line connecting the first and second feed points to the radio device circuit. The coaxial feed line is arranged so that currents flowing from the first and second feed points into the coaxial feed line through parts of the first and second quarter wavelength elements and the short-circuit element, respectively, are almost opposite in phase to each other.

More specifically, the coaxial feed line has an outer conductor having one end connected to the first feed point and a central conductor having one end connected to the second feed points. The outer conductor is arranged along the first segment of the short-circuit element and the first quarter wavelength element, and branched from the middle position between the first and second quarter wavelength elements. The outer conductor is electrically connected to the first segment of the short-circuit element and the first quarter wavelength element.

In the antenna apparatus configured as stated above, currents flowing from the two feed points into the first and second segments of the short-circuit element, respectively, are divided from the connection point with the quarter wavelength elements to the quarter wavelength elements and the short-circuit element. The currents flowing into the quarter wavelength elements are composed at a position at which the coaxial feed line is branched and flows into the outer conductor of the coaxial feed line as a leak current. Since the currents flowing into the quarter wavelength elements through the first and second segments of the short-circuit element are almost opposite in phase to each other, a leak current on the outer conductor of the coaxial feed line becomes almost zero. Thus, the influence of the leaked noise from the radio device circuit is extremely improved and good communication quality can be realized, compared with the conventional antenna apparatus.

Yet another antenna apparatus according to the present invention is comprised of a linear element provided proximate to the surface of a metal housing including a radio device circuit and having one end serving as the first feed point; a helical element having one end in the vicinity of the first feed point of the linear element serving as the second feed point; a half wavelength element connected to the other end of the helical element; and a feed line provided in parallel to the linear element in proximity to the surface of the metal housing and connecting the first and second feed points to the radio device circuit. The helical element is arranged so that at least part of the helical element overlaps the feed line.

For example, a coaxial feed line having an outer conductor having one end connected to the first feed point and a central conductor having one end connected to the second feed point is used as the feed line. The helical element is arranged to be helical above the coaxial feed line, whereby a current almost opposite in phase to that flowing through the surface of the outer conductor flows through the helical element. That is, the helical element is arranged to form a radiation field canceling unnecessary radiation resulting from the current flowing through the surface of the outer conductor.

In this antenna apparatus, the helical element is put proximate to the feed line in almost parallel to each other in the vicinity of the feed points. The unnecessary radiation caused by the current on the feed line is canceled by the current flowing through the helical element, whereby the ripple of the radiation pattern in the horizontal plane is reduced and good non-directivity in the horizontal plane can be obtained.

Still another antenna apparatus according to the present invention is comprised of a linear antenna having a length of a half wavelength and provided in the vicinity of a metal housing including a radio device circuit; a quarter wavelength element having one end connected to the proximal end of the linear antenna; and a feed line connecting the other end of the quarter wavelength element to the radio device circuit. One end of the quarter wavelength element is connected to the proximal end of the linear antenna at a position below the upper end of the metal housing and the other end of the quarter wavelength element is connected to the feed line on the upper end of the metal housing.

In this antenna apparatus, the current on the linear antenna having a length of a half wavelength is opposite in phase to that on the quarter wavelength element having a length of a quarter wavelength. If viewed from the other end of the quarter wavelength element which is a feed point, the linear antenna is directed upward and the quarter wavelength element is directed downward. The electromagnetic field radiated from the linear antenna and that from the quarter wavelength element have, therefore, the same phase, and the radiation level, i.e., gain on the horizontal plane increases.

Furthermore, the present invention provides a radio device having the antenna apparatus, the radio device circuit and the metal housing stated above.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIGS. 10A, 10B and 10C show radiation patterns on respective planes of the antenna shown in FIG. 9;

FIGS. 17A, 17B and 17C show radiation patterns on the respective planes of the antenna in the third embodiment;

FIG. 21 is a perspective view showing the configuration of an antenna apparatus and a radio device in the fourth embodiment according to the present invention;

FIG. 22 is a perspective view showing the enlarged important parts of the fourth embodiment;

FIGS. 23A and 23B show radiation patterns on respective planes of the antenna in the fourth embodiment; and FIG. 24 shows a calculation result of an average gain in the horizontal plane of the antenna in the fourth embodiment.

DETAILED DESCRIPTION OF THE INVENTION

A preferred embodiment of an antenna apparatus according to the present invention will now be described with reference to the accompanying drawings.

First Embodiment

Figure 11:
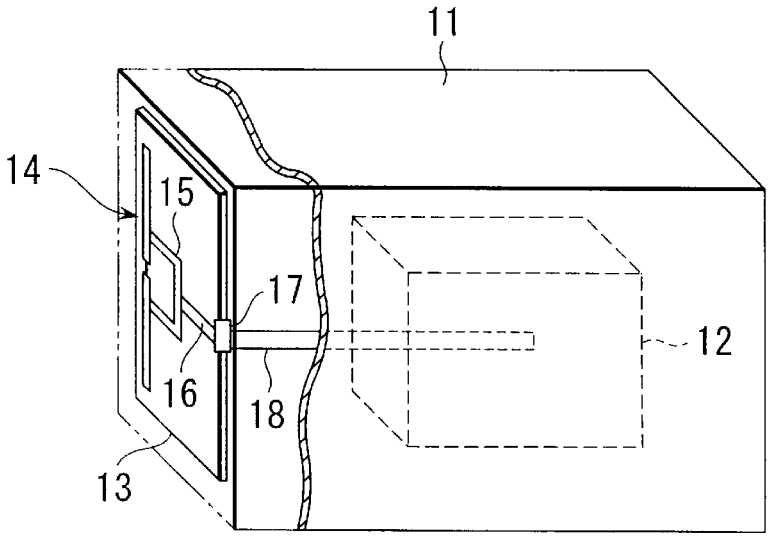
FIG. 11 is a perspective view showing the schematic views of an antenna apparatus and a radio device in the first embodiment according to the present invention.

FIG. 11 is a perspective view showing the schematic configuration of a portable radio device including an antenna apparatus in this embodiment. A housing 11 is a metal housing which also serves as a shield member and includes a radio device circuit 12 therein. The radio device circuit 12 includes a radio circuit section, a signal processing section, an information processing section, a power circuit section, an external interface section and the like.

Figure 12A:
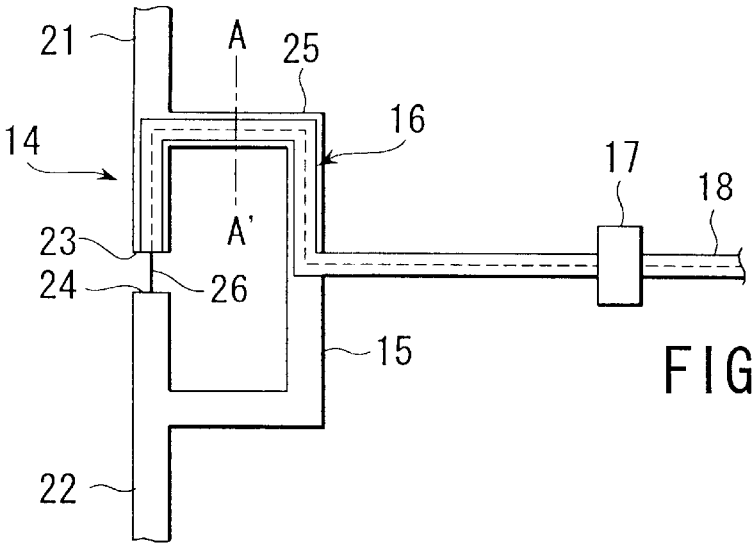
FIG. 12A is a plan view showing the enlarged important parts of the first embodiment.
Figure 12B:
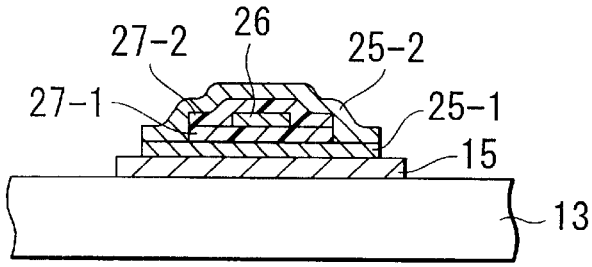
FIG. 12B is a cross-sectional view taken along line A–A' of FIG. 12A.

FIGS. 12A and 12B are a plan view and a cross-sectional view taken along line A–A' which show the detailed configuration of an antenna apparatus, respectively. As shown in FIG. 11, an antenna board 13 is disposed in proximity to one surface of the metal housing 11 of a rectangular parallelepiped shape and a dipole antenna 14, a short-circuit element 15 and a coaxial feed line 16 are formed on the antenna board 13.

The dipole antenna 14 consists of two linear elements (quarter wavelength elements) 21 and 22 linearly provided and each having a length of a quarter wavelength. The opposite end portions of the quarter wavelength elements 21 and 22 are feed points 23 and 24, respectively. The short-circuit element 15 is formed to cause a short-circuit between the quarter wavelength elements 21 and 22 at an appropriate position, thereby T-matching the dipole antenna 14. A matching characteristic of T-matching depends on the connection point. The appropriate position is determined based on the matching characteristic of T-matching. No restrictions are given to the short-circuiting position and the shape of the short-circuit element 15 and the position of the short-circuit element 15 at which the coaxial feed line 16 is branched.

The coaxial feed line 16 connects the two feed points 23 and 24 of the dipole antenna 14 to the radio circuit section of the radio device circuit 12 and consists of an outer conductor 25 and a central conductor 26. One end of the outer conductor 25 is connected to the feed point 23 of one quarter wavelength element 21 and one end of the central conductor 26 is exposed from one end of the outer conductor 25 and connected to the feed point 24 of the other quarter wavelength element 22.

The coaxial feed line 16 is arranged along part of the quarter wavelength element 21 (an area from the feed point 23 to the one end side of the short-circuit element 15) and along part of the short-circuit element 15. The coaxial feed line 16 is branched from the central portion of the short-circuit element 15 (the central position of the short-circuit element 15 in the longitudinal direction of the dipole antenna 14) and connected to the radio circuit 12. The outer conductor 25 starts at the feed point 23 and is electrically connected to the quarter wavelength element 21 and the short-circuit element 15. The central conductor 26 takes the same route as that of the outer conductor 25 except for a portion exposed from the outer conductor 25.

The coaxial feed line 16 branched from the central portion of the short-circuit element 15 is extended toward a right end in FIG. 12A on the antenna board 13 and connected to a coaxial feed line 18 through a coaxial connector 17.

As the cross-sectional view taken along line A–A' of FIG. 12A is shown in FIG. 12B, the dipole antenna 14, the short-circuit element 15 and the coaxial feed line 16 are formed by the multilayer printing technique in this embodiment.

Namely, first, the dipole antenna 14 (quarter wavelength elements 21 and 22) and the short-circuit element 15 are formed, as the first conductive layer, on the antenna board 13. The lower conductor 25-1 of the outer conductor 25 of the coaxial feed line 16 is formed as the second conductive layer on the first conductive layer. The central conductor 26 is formed above the lower conductor 25-1 through a lower insulating layer 27-1. An upper insulating layer 27-2 is formed on the central conductor 26. The insulating layers 27-1 and 27-2 isolate the outer conductor 25 (25-1 and 25-2) of the coaxial feed line 16 from the central conductor 26 and formed to be narrower than the lower conductor 25-1. The upper conductor 25-2 of the outer conductor 25 is formed, as the third conductor, on the upper insulating layer 27-2 and electrically connected to the lower conductor 25-1 on both sides in the width direction of the upper conductor 25-2.

In this embodiment, it is possible to prevent the dipole antenna 14 from receiving leaked noise while the dipole antenna 14 maintains good input characteristics. Now, the result of the characteristics of this antenna apparatus will be described and thereafter the principle of improving the characteristics will be described.

The inventors of the present invention calculated matching loss by employing an antenna model for a radio device constituted according to this embodiment. The length of the coaxial feed line 16 was selected to be three lengths, i.e., a twelfth wavelength, a quarter wavelength and a half wavelength. As a result of the calculation, it was found that the matching loss at any length was 0.5 dB at most and the antenna exhibited very good input characteristics without depending on the length of the feed line 16.

Figure 13:
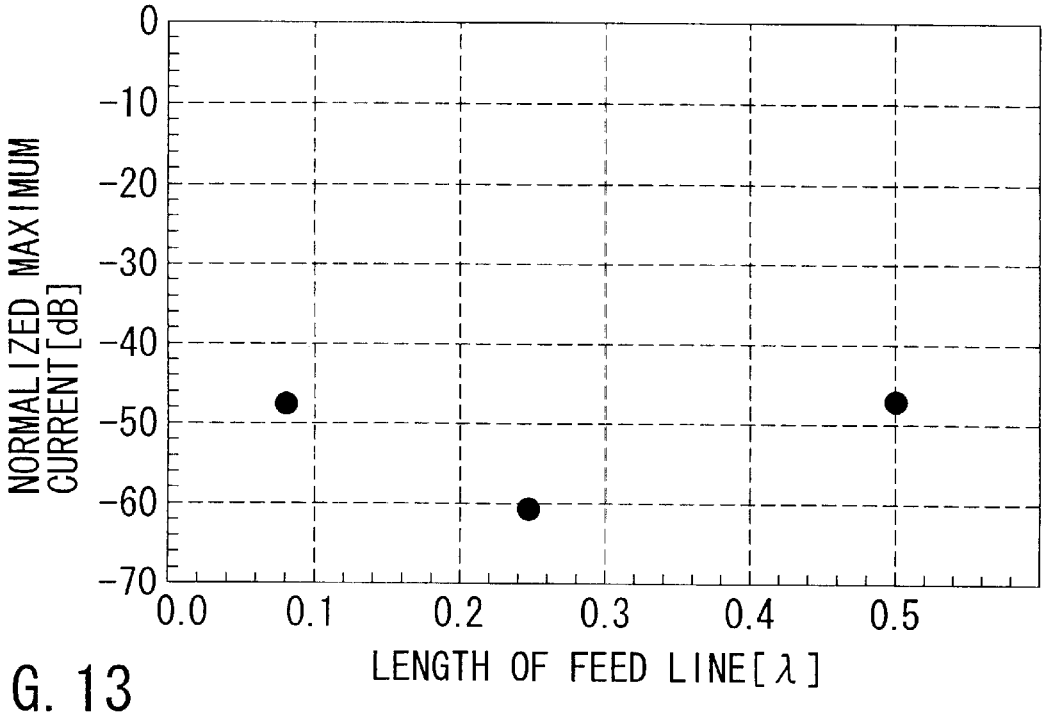
FIG. 13 is a graph showing the change of leaked noise current on a feed line if the length of a coaxial feed line is changed in the first embodiment.

FIG. 13 shows the evaluation results of the performance of the dipole antenna 14 with respect to noise leaked to the coaxial feed line 16 while employing the radio device antenna model. The length of the coaxial feed line 16 was selected to be a twelfth wavelength, a quarter wavelength and a half wavelength. As in the case of FIG. 6 described above, the evaluation was carried out by calculating the current leaked to the coaxial feed line 16 from the dipole antenna 14 while a current is fed to the feed points 23 and 24 to turn the antenna into a transmission state.

Figure 1:
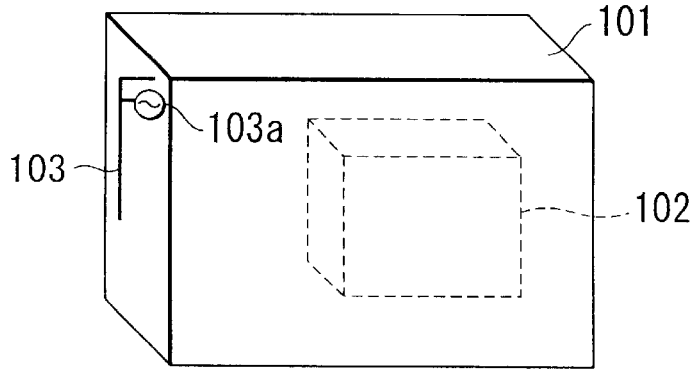
FIG. 1 PRIOR ART
FIG. 1 is a perspective view of a portable radio device employing a conventional built-in inverted F-type antenna.
Figure 2:
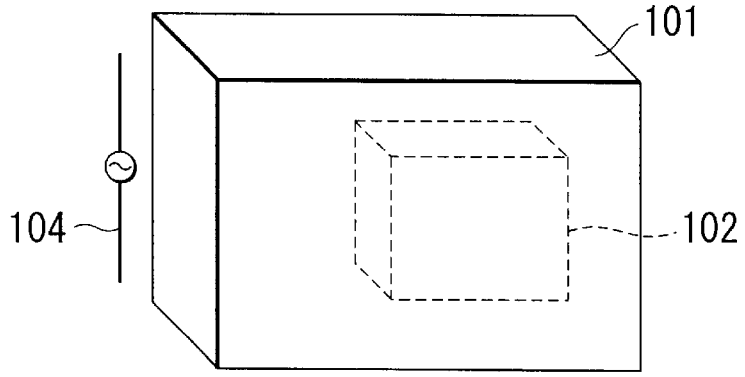
FIG. 2 PRIOR ART
FIG. 2 is a perspective view of a portable radio device employing a conventional built-in dipole antenna.
Figure 3:
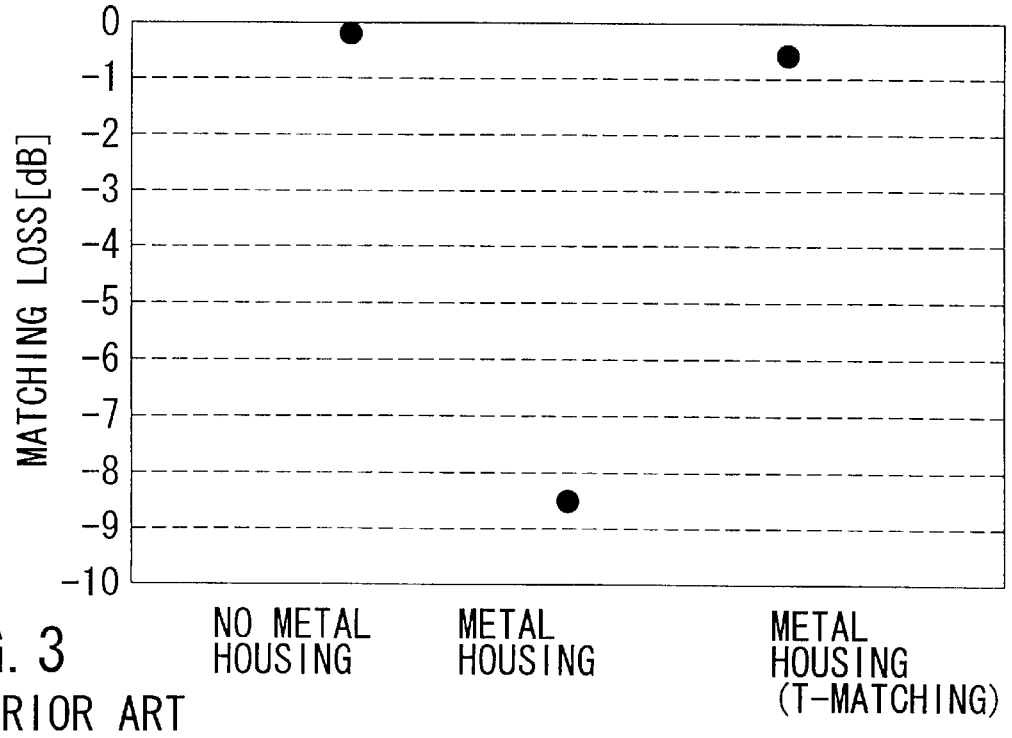
FIG. 3 PRIOR ART
FIG. 3 show matching loss in various states of a dipole antenna.
Figure 4:
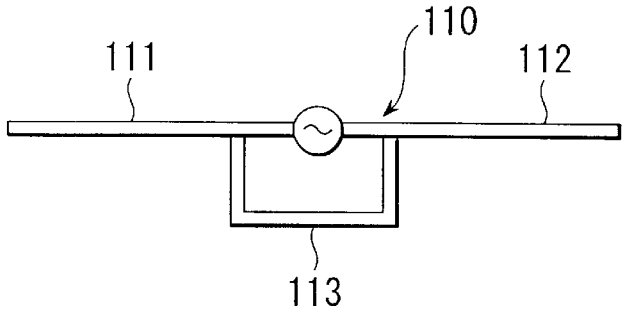
FIG. 4 PRIOR ART
FIG. 4 is an explanatory view of a dipole antenna which has been T-matched.
Figure 5:
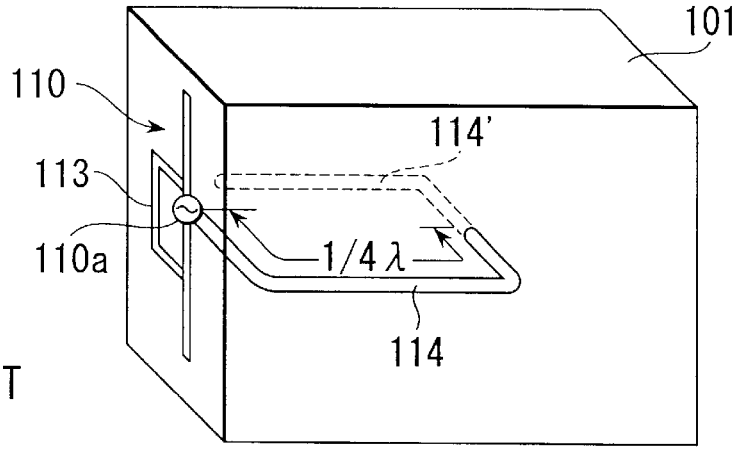
FIG. 5 PRIOR ART
FIG. 5 is a perspective view of a portable radio device employing a conventional T-matched dipole antenna.

As is obvious from FIG. 13, although the quantity of the leaked current is changed depending on the length of the coaxial feed line 16 as in the case of the conventional T-matched dipole antenna shown in FIGS. 4 and 5, only a low current of not less than 30 dB was leaked to the feed line 16 at any length, i.e., a twelfth wavelength, a quarter wavelength and a half wavelength, compared with the conventional antenna.

Now, the principle of improving antenna characteristics by the configuration of this embodiment will be briefly described.

First, the reason the antenna has good input characteristics will be described. As already described, if the dipole antenna is T-matched, the input characteristics of the antenna is improved. In this embodiment, the short-circuit element 15 for short-circuiting the two quarter wavelength elements 21 and 22 of the dipole antenna 14 is employed and this can improve the input characteristics of the antenna by the T-matching effect.

Figure 14:
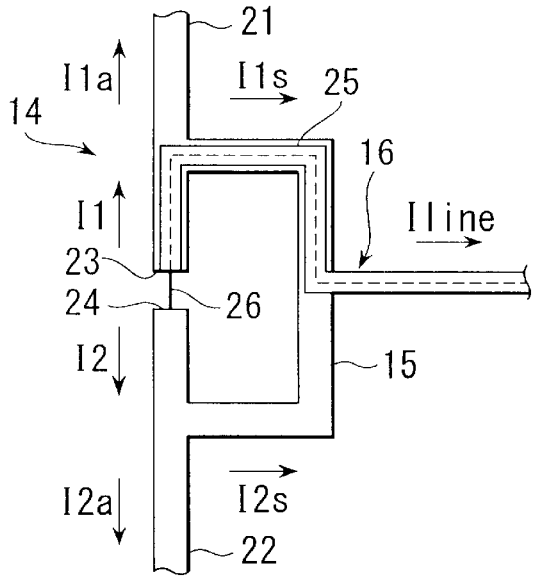
FIG. 14 shows a current flowing through the respective parts of an antenna section to explain the principle of not receiving high frequency noise leaked on the coaxial feed line in the first embodiment.

Next, the reason for good antenna characteristics with respect to the noise leaked to the feed line will be described with reference to FIG. 14.

Figure 6:
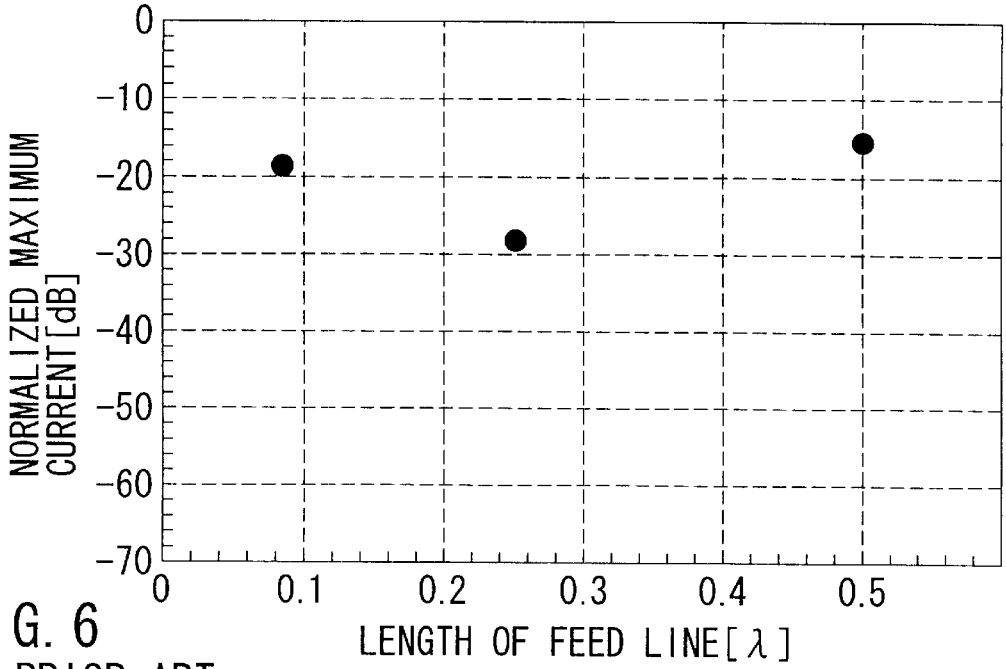
FIG. 6 PRIOR ART
FIG. 6 is a graph showing the change of leaked noise current on a feed line in a case where the length of a coaxial feed line is changed in the configuration of FIG. 5.
Figure 7A:
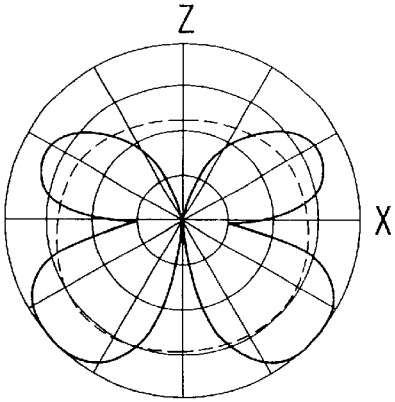
FIG. 7A PRIOR ART
FIGS. 7A and 7B show radiation patterns on respective planes of a conventional helical antenna.
Figure 7B:
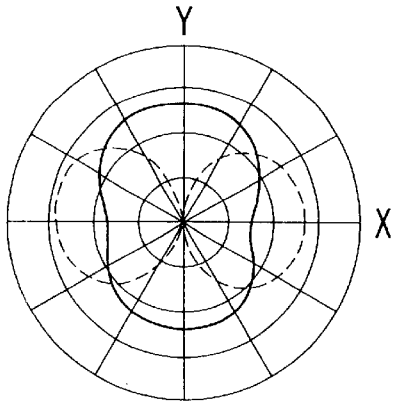
FIG. 7B PRIOR ART
Figure 7C:
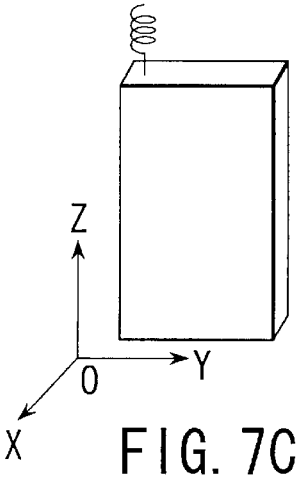
FIG. 7C PRIOR ART
FIG. 7C shows a radio device model.
Figure 8C:
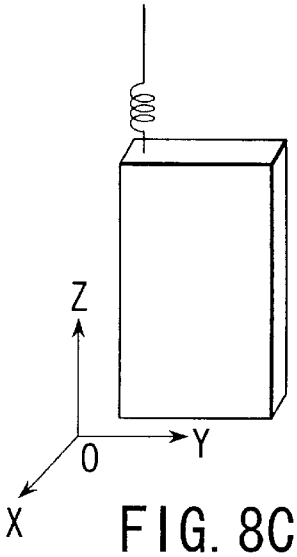
FIG. 8C PRIOR ART
FIG. 8C shows a radio device model.
Figure 8A:
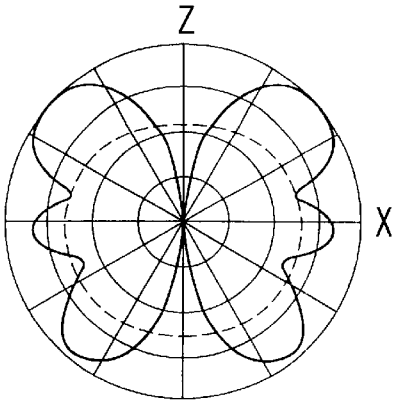
FIG. 8A PRIOR ART
FIGS. 8A and 8B show radiation patterns on respective planes of a conventional helical antenna to which a half wavelength element is attached.
Figure 8B:
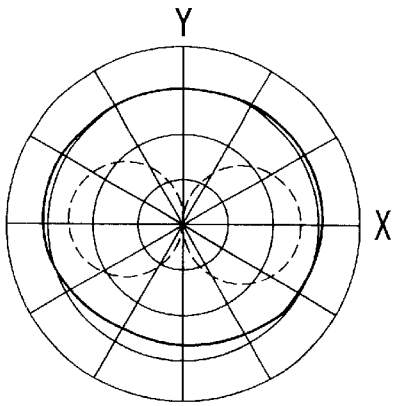
FIG. 8B PRIOR ART

As in the case of the evaluation methods shown in FIGS. 13 and 6, description will be given while assuming that the dipole antenna 14 is in a transmission state. As shown in FIG. 14, currents I1 and I2 flow through the quarter wavelength elements 21 and 22 of the dipole antenna 14 from the feed points 23 and 24, respectively. These currents I1 and I2 are branched into those flowing through the quarter wavelength elements 21 and 22 and those flowing through the short-circuit element 15 at the connections of the short-circuit element 15. The currents flowing through the quarter wavelength elements 21 and 22 are denoted by I1*a* and I2*a*, and those flowing through the short-circuit element 15 are denoted by I1s and I2s. The currents I1*a* and I2*a* flowing through the quarter wavelength elements 21 and 22, respectively are radiated into a space as a radiation wave source.

Meanwhile, the currents I1s and I2s flowing through the short-circuit element 15 are composed at a position at which the coaxial feed line 16 is branched and flow through the outer conductor 25 of the coaxial feed line 16 as a leak current of $I_{line}$=I1s+I2s from the dipole antenna 14.

If the short-circuit element 15 is provided almost symmetrically with respect to the dipole antenna 14, i.e., the both ends of the short-circuit element 15 are connected at positions almost equidistant from the feed points 23 and 24 of the quarter wavelength elements 21 and 22, then the currents I1s and I2s flowing through the short-circuit element 15 become almost opposite in phases to each other (I1s≈−I2s). It is actually common to connect the short-circuit element 15 so as to be symmetric with respect to an antenna when the dipole antenna is T-matched and the relationship of I1s≈−I2s can be obtained.

In this way, the phases of the currents on the short-circuit element 15 are opposite to each other (I1s≈−I2s), so that the leak current on the outer conductor 25 of the coaxial feed line 16 is $I_{line}$=I1s+I2s≈I1s−I1s=0.

Further, if the current leaked onto the outer conductor 25 of the coaxial feed line 16 from the dipole antenna 14 during transmission is low, it means that the electromagnetic coupling between the feed points 23 and 24 of the dipole antenna 14 with each point on the coaxial feed line 16 is small. Eventually, even if a current resulting from the leaked noise from the radio device circuit 12 spreads on the outer a conductor 25 of the coaxial feed line 16 during reception, the influence of the leaked noise on the currents at the feed points 23 and 24 is low. That is to say, the configuration which has no dependence on the length of the coaxial feed line 16 can prevent the dipole antenna 14 from receiving noise leaked to the feed line 16 and attain the objects of the present invention.

As stated above, in this embodiment, the coaxial feed line is connected to the T-matched dipole antenna so that the currents flowing through the two quarter wavelength elements cancel each other and the leak current on the outer conductor becomes zero. Due to this, it is possible to eliminate the influence of the leaked noise irrespectively of the length of the feed line.

Next, other embodiments according to the present invention will be described. It is noted that the same constituent elements in the following embodiments corresponding to those in the first embodiment are denoted by the same reference symbols and no detailed description will be given thereto.

Second Embodiment

Figure 15:
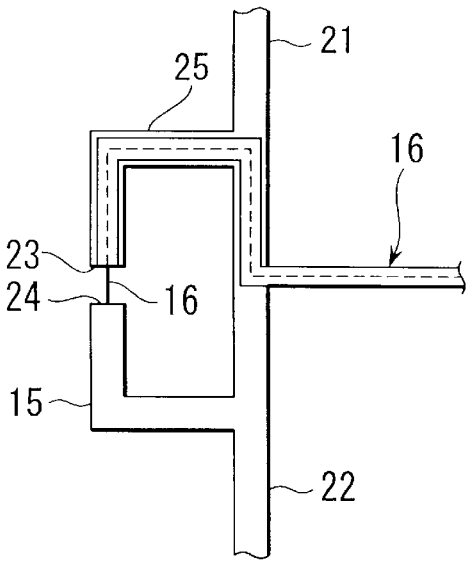
FIG. 15 is a plan view showing the configuration of the important parts of an antenna apparatus in the second embodiment according to the present invention.

FIG. 15 is a plan view of the important parts of an antenna apparatus in the second embodiment according to the present invention. In this embodiment, the central portion of the short-circuit element 15 is cut off and the opposite end portions of the short-circuit element 15 at the cutoff portion are set at feed points 23 and 24. The second embodiment is the same as the first embodiment in that the short-circuit element 15 is formed to cause a short-circuit between the quarter wavelength elements 21 and 22 of the dipole antenna 14 at an appropriate position.

The coaxial feed line 16 connects the two feed points 23 and 24 of the short-circuit element 15 with the radio circuit section of the radio device circuit 12. One end of the outer conductor 25 of the feed line 16 is connected to the feed point 23 and one end of a central conductor 26 thereof is exposed from one end of the outer conductor 25 and connected to the other feed point 24.

The coaxial feed line 16 is arranged along part of the short-circuit element 15 (an area from the feed point 23 to the quarter wavelength element 21) and part of the quarter wavelength element 21, and branched from the middle position between the quarter wavelength elements 21 and 22 (at which branched point, the feed line 16 is also connected to the quarter wavelength element 22). Further, the outer conductor 25 starts at the feed point 23 and is electrically connected to the short-circuit element 15 and the quarter wavelength element 21. The central conductor 26 takes almost the same route as that of the outer conductor 25 except for the portion exposed from the outer conductor 25.

The coaxial feed line 16 branched from the middle position between the quarter wavelength elements 21 and 22 is extended toward the end portion on an antenna board which is not shown in FIG. 15 and connected to another coaxial feed line reaching the radio device through a coaxial connector which is not shown therein.

Even in this embodiment, it is obvious that an effect similar to that in the first embodiment can be obtained.

Third Embodiment

Figure 16:
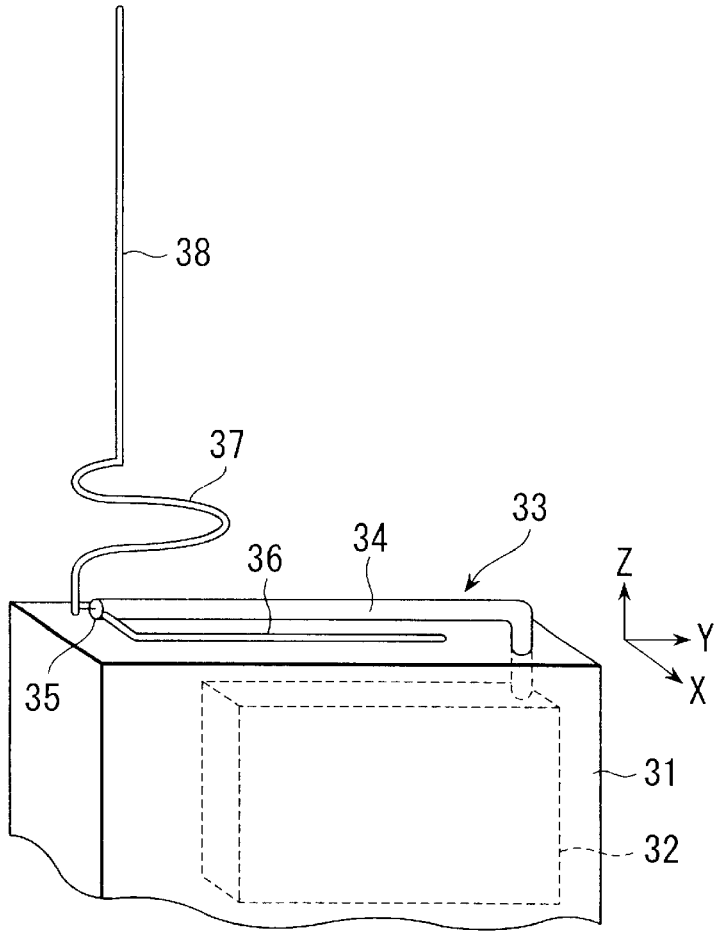
FIG. 16 is a perspective view showing the configuration of an antenna apparatus and a radio device in the third embodiment according to the present invention.

FIG. 16 is a perspective view showing the configuration of a portable radio device including an antenna apparatus in the third embodiment according to the present invention. The antenna apparatus in this embodiment is constituted so that a radiation pattern in a horizontal plane is omni-directional by employing an antenna having a helical element and a half wavelength element.

A coaxial feed line 33 consisting of an outer conductor 34 and a central conductor 35 and a linear element 36 are provided parallel to each other in proximity to the surface of a metal housing 31 including a radio device circuit 32 therein. One end of the linear element 36 is the first feed point and electrically connected to one end of the outer conductor 34 of the coaxial feed line 33. The other end of the coaxial feed line 33 is connected to the radio device circuit 32.

One end of the helical element 37 in the vicinity of the feed point of the linear element 36 is set at the second feed point and connected to the central conductor 35 of the coaxial feed line 33. One end of a half wavelength element 38 is connected to the other end of the helical element 37.

Above the coaxial feed line 33, the helical element 37 is arranged and constituted to be helical almost in parallel to the feed line 33. Namely, the helical element 37 is extended upward from the second feed point above at right angle with respect to the coaxial feed line 33, bent in a direction parallel to the feed line 33 and helical above the feed line 33. As a result, a current almost opposite in phase to that flowing through the surface of the outer conductor 34 of the coaxial feed line 33 flows through the helical element 37 and cancels the unnecessary current flowing on the outer conductor 34.

FIGS. 17A, 17B and 17C show calculation results of radiation patterns on the ZX plane, ZY plane and YX plane of the antenna apparatus shown in FIG. 16, respectively. As can be seen from these results, the cross polarized wave components (horizontal polarized wave components) of the radiation patterns are decreased compared with those of the radiation patterns of the conventional antenna apparatus (FIGS. 10A, 10B and 10C) shown in FIG. 9, the symmetry of the radiation pattern in the ZY plane is improved and consequently the ripple of the vertical polarized waves in the horizontal plane (XY plane) is considerably reduced.

Figure 18:
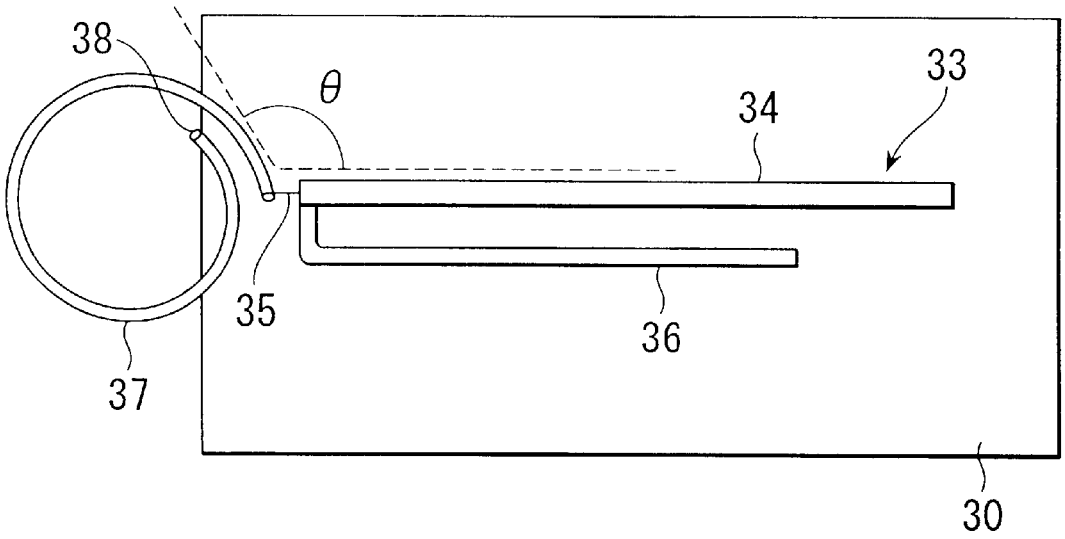
FIG. 18 is a plan view showing the important parts of the third embodiment.

FIG. 18 is a plan view of the antenna section of the portable radio device shown in FIG. 16. It is assumed that the angle of the coaxial feed line 33 and the linear element 36 with respect to the initial winding portion of the helical element 37 in the horizontal plane is θ. In the conventional antenna apparatus shown in FIG. 9, the angle θ is 180°. The angle θ is 0° in FIG. 16.

Figure 19:
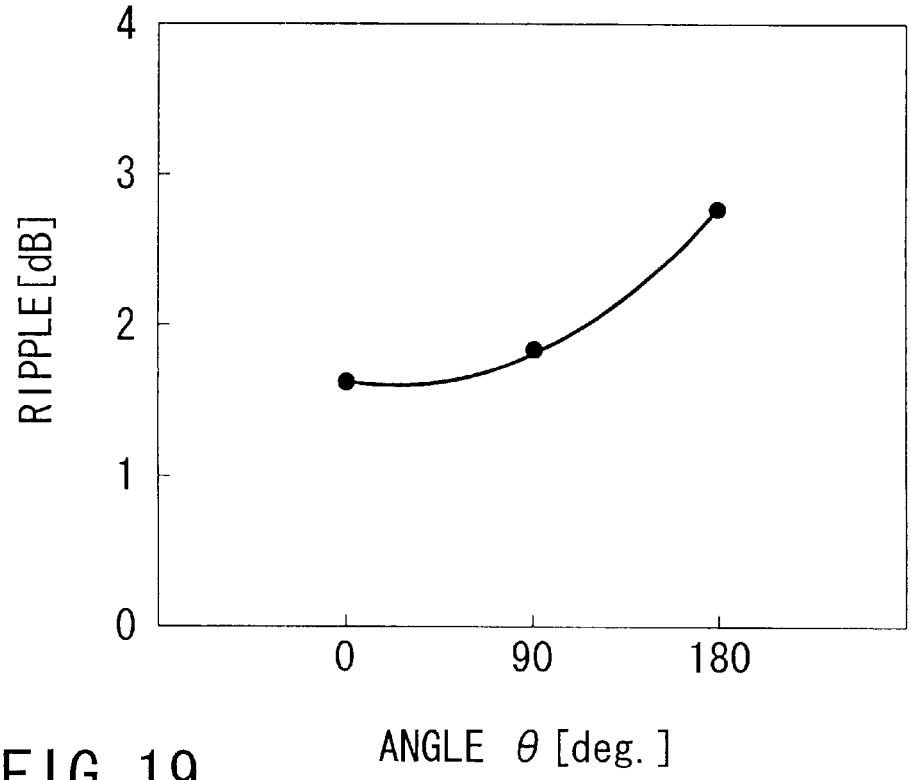
FIG. 19 is a graph showing the relationship between a helical element attachment angle θ and the ripple of a radiation pattern in FIG. 18.

FIG. 19 shows the change of the ripple of the radiation pattern in the horizontal plane in relation to the change of the angle θ. At an angle θ=0°, the ripple can be reduced by not less than 1 dB, compared with an angle θ=180°, which demonstrates the effectiveness of the present invention. Further, this result shows that the angle is not necessarily θ=0° and that a good ripple reduction effect can be obtained as long as the angle is not more than θ=90°.

Next, description will be given to the reason the radiation pattern in the horizontal plane is improved by the configuration of this embodiment with reference to FIGS. 20A, 20B and 20C.

Figure 20A:
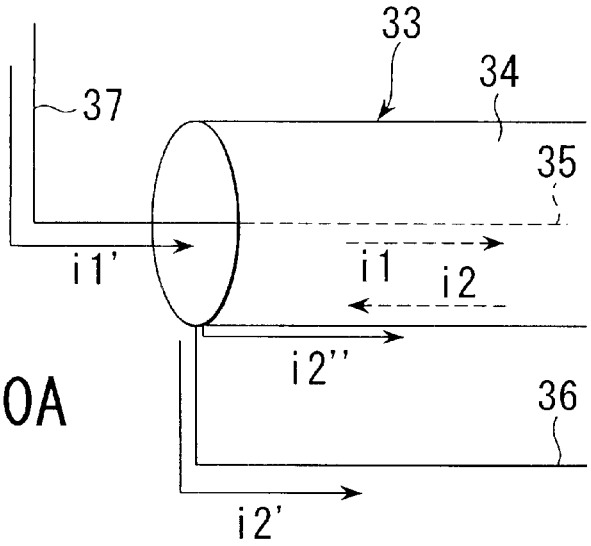
FIGS. 20A, 20B and 20C are explanatory views for the effect of decreasing the ripple of the radiation pattern in the third embodiment.

FIG. 20A qualitatively shows currents flowing through the coaxial feed line 33 (outer conductor 34 and central conductor 35), the linear element 36 and the helical element 37 during reception. Inside the coaxial feed line 33, the surface of the central conductor 35 and the inner surface of the outer conductor 34 are paired with each other and high frequency currents i1 and i2 flow therethrough, respectively. The currents i1 and i2 are opposite in phase to each other.

The current i1 flowing through the surface of the central conductor 35 flows, as a current i1', through the helical element 37. The current i2 flowing through the inner surface of the outer conductor 34 flows not only through the linear element 36 as a current i2' but also through the surface of the coaxial feed line 33 (outer surface of the outer conductor 34) as a current i2". The latter current i2" is considered to be one of the causes for unnecessary radiation from the coaxial feed line 33.

Now, if the helical element 37 is arranged to be helical above the coaxial feed line 33 according to the configuration of this embodiment shown in FIG. 16, the unnecessary radiation caused by the current i2" in question is reduced. In other words, as is obvious from FIG. 20B, the current i1' flowing through the helical element 37 in this case is opposite in phase to the current i2" flowing through the surface of the outer conductor 34 of the coaxial feed line 33 and these currents cancel each other. A radiation field "A" generated by a combination of the current i1' and the current i2" is proportional to the difference between the currents i1' and i2" (A i1'−i2").

Figure 9:
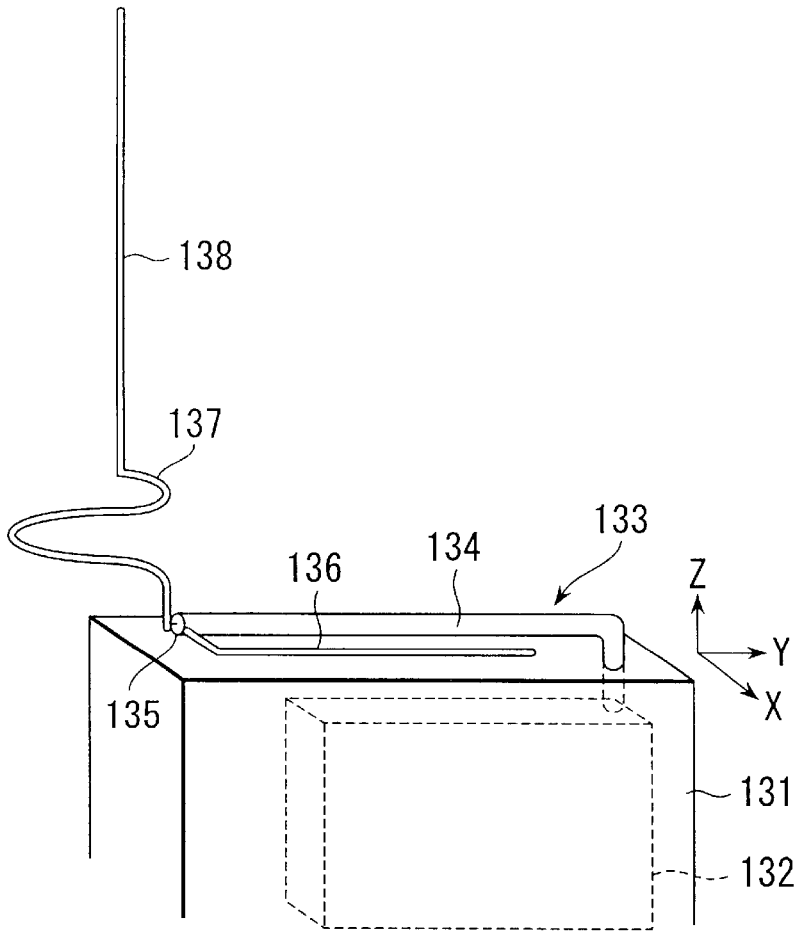
FIG. 9 PRIOR ART
FIG. 9 is a perspective view of a portable radio device employing a helical antenna to which a half wavelength element is attached.
Figure 20B:
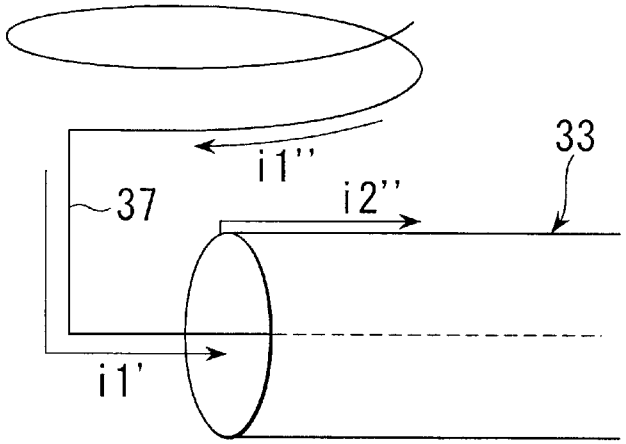
Figure 20C:
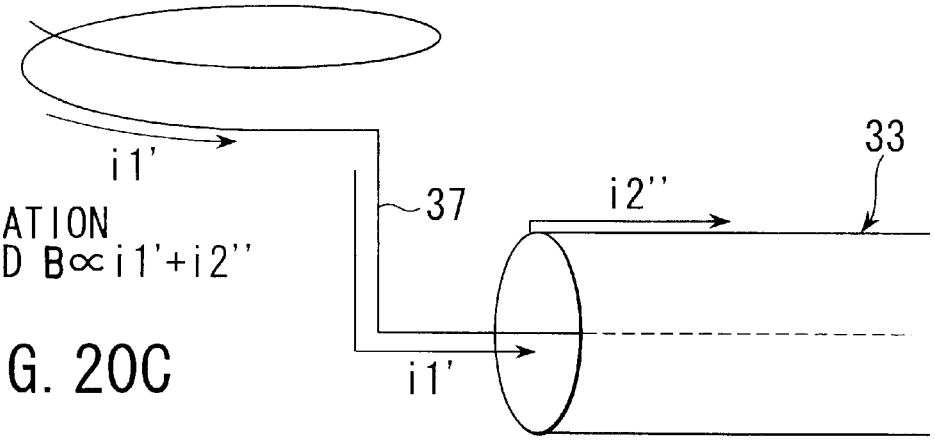

On the other hand, if the helical element 37 is arranged to be helical at a position other than above the coaxial feed line 33 as shown in FIG. 20C according to the conventional configuration shown in FIG. 9, the current i1' is the same in phase as the current i2", so that radiation fields generated by the currents i1' and i2" are added together. Therefore, the radiation field "B" generated by a combination of the currents i1' and i2" is proportional to the sum of the currents i1' and i2" (B i1'+i2"). Obviously, the relationship between the radiation fields "A" and "B" is "A"<"B".

FIG. 20B corresponds to the ripple characteristics of the radiation pattern in the horizontal plane shown in FIG. 19 at an angle of θ=0°. FIG. 20C corresponds to that at an angle of θ=180°. It is considered that the reason the ripple is more suppressed in FIG. 20B than in FIG. 20C is due to the effect of canceling unnecessary radiation by the helical element 37.

As described above with reference to FIG. 19, the angle θ not more than 90° is effective even though not 0°. That is, it is not always necessary that the helical element 37 is positioned completely above the coaxial feed line 33 as shown in FIG. 16 and may be slightly rotated from the state shown in FIG. 16. In short, it suffices that the helical element 37 is arranged such that at least part of the element 37 is positioned above the coaxial feed line 33, thereby exercising the effect that the currents i1' and i2" somewhat cancel each other.

Fourth Embodiment

FIG. 21 is a perspective view showing the schematic configuration of a portable radio device including an antenna apparatus in the fourth embodiment according to the present invention. In the antenna apparatus in this embodiment, a linear antenna (half wavelength element) 43 having a length of a half wavelength is provided in the vicinity of a metal housing 41 including a radio device circuit 42 therein and supported by an antenna support body which is not shown in FIG. 21.

One end of an element 44 having a length of a quarter wavelength is connected to the proximal end of the linear antenna 43. The other end of this element 44 is connected to a radio device circuit 42 through a feed line 45. The element 44, though not limited thereto, is formed helically in this embodiment and the linear antenna 43 is arranged to pass through the inside of the spiral of the element 44.

FIG. 22 is an enlarged view showing the element 44 and the neighborhood of the element 44. As shown therein, one end of the element 44 (connection point 44B) is connected to the proximal end of the linear antenna 43 at a position below the upper end surface of the metal housing 41. In other words, the proximal end of the linear antenna 43 is arranged below the upper end surface of the metal housing 41. On the other hand, the other end of the element 44 is a feed point 44A and connected to the feed line 45 on the upper end surface of the metal housing 41.

That is, if viewed from the feed point 44A, the element 44 which is a quarter wavelength element, is formed as a downward element and the linear antenna 43 which is a half wavelength element, is an upward element. With such a configuration, the antenna apparatus in this embodiment has an advantage of effectively increasing the radiation level (radiation quantity) of the antenna on the horizontal plane. The reason for the increase of the radiation quantity is as follows.

While the length of the linear antenna 43 is a half wavelength, that of the element 44 is a quarter wavelength. The high frequency current on the linear antenna 43 is opposite in phase to that on the element 44. In terms of the mechanical direction of the antenna elements, the linear antenna 43 is directed upward and the element 44 is directed downward as already stated above. The electromagnetic field radiated from the linear antenna 43 and that from the element 44 are the same in phase, with the result the radiation quantity increases.

FIGS. 23A and 23B show the calculation results of the radiation patterns by employing a radio device model according to this embodiment. Specifically, FIG. 23A shows a radiation pattern on a vertical plane (XZ plane) to the ground and FIG. 23B shows a radiation pattern on a horizontal pattern (XY plane) to the ground. In this model, the element 44 is formed to be helical and the linear antenna 43 is arranged to pass through the inside of the spiral of the element 44 as shown in FIGS. 21 and 22.

As is obvious from the radiation pattern on the horizontal plane shown in FIG. 23B, the quantity of radiation shows a great increase and non-directivity on the horizontal plane is realized. The radiation pattern on the vertical plane shown in FIG. 23A indicates that the maximum radiation direction is horizontal.

FIG. 24 shows a calculation result of the average gain in the horizontal plane of the fourth embodiment. The abscissa denotes the distance between the lower end B of the element 44 and the upper end surface of the metal housing 41. The ordinate denotes the average gain in the horizontal plane. When the lower end B of the element 44 and the upper end surface of the metal housing 41 are substantially the same height, the gain is not greater than 0 dBi. If the lower end B of the element 44 is positioned lower than the upper end surface of the metal housing 41 by a quarter wavelength, the gain is improved by 2 dBi. Thus, a maximum gain is obtained when the lower end B of the element 44 is positioned lower than the upper end surface of the metal housing 41 by a quarter wavelength. However, there may be a case in which the lower end B of the element 44 is freely positioned due to an interference with other elements of the radio device. Though the maximum gain is not obtained, it is desirable to positioned the lower end B of the element 44 lower than the upper end surface of the metal housing 41 by 0.06 $\lambda$ if it is sufficient to improve the gain by 1 dBi.

As can be seen from the above, the antenna apparatus in this embodiment can obtain very high level radiation patterns with non-directivity on the horizontal plane. Due to this, the antenna apparatus is quite suitable for a portable radio device terminal such as a portable telephone and a PHS terminal and the antenna apparatus ensures establishing good communication.

As described above, according to one aspect of the present invention, the antenna apparatus employing the T-matched dipole antenna, the coaxial feed line is arranged from the feed point of the dipole antenna along one of the quarter wavelength elements of the dipole antenna and the short-circuit element and branched from the center of the short-circuit element, thereby making it possible to decrease the influence of leaked noise by not less than 30 dB compared with the conventional apparatus and to realize good communication quality.

Further, according to another aspect of the present invention, in the antenna apparatus having the helical element used as one of the elements of the dipole antenna, the helical element is put proximate to the feed line almost in parallel to each other in the vicinity of the feed points and the unnecessary radiation resulting from a current on the feed line is canceled by the current flowing through the helical element, thereby making it possible to reduce the ripple of the radiation pattern in the horizontal plane and to realize good non-directivity in the horizontal plane.

Moreover, according to still another aspect of the present invention, the matching element having a length of a quarter wavelength is connected to the feed line on the upper end of the metal housing and connected to the linear antenna having a length of a half wavelength at a position below the upper end of the metal housing, thereby making it possible to extremely increase the radiation quantity, i.e., gain in the horizontal plane, compared with the conventional antenna apparatus.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, while the respective embodiments have been described solely, it is possible to appropriately combine a plurality of embodiments.

What is claimed is:

1. An antenna apparatus comprising:

a dipole antenna having first and second quarter wavelength elements, end portions of the first and second quarter wavelength elements being first and second feed points;

a short-circuit element connected between the first and second quarter wavelength elements, thereby T-matching the dipole antenna; and a feed line connected to the first and second feed points, said feed line being configured so that a first current flowing into said feed line from the first feed point through said first quarter wavelength element and a part of said short-circuit element and a second current flowing into the feed line from the second feed point through the second quarter wavelength element and a remaining part of the short-circuit element are almost opposite in phase.

2. The antenna apparatus according to claim 1, wherein a part of said feed line is overlapped with a part of said short-circuit element.

3. The antenna apparatus according to claim 1, wherein a part of said feed line is overlapped with one of said first and second quarter wavelength elements and a part of said short-circuit element and said feed line is branched at a central portion of said short-circuit element.

4. The antenna apparatus according to claim 1, wherein said first and second quarter wavelength elements are linearly provided and end portions opposite each other is the first and second feed points; and said feed line is a coaxial feed line, an outer conductor of said feed line being connected to said first quarter wavelength element and said short-circuit element, a central conductor of said feed line being connected to the second feed point, and a tip end of said outer conductor being connected to said first feed point.

5. A radio device comprising:

the antenna apparatus according to claim 1;

a radio device circuit connected to said first and second feed points through said feed line; and a metal housing for housing said radio device, said dipole antenna being arranged near a surface of said metal housing.

6. An antenna apparatus comprising:

a dipole antenna having first and second quarter wavelength elements;

a short-circuit element connected between said first and second quarter wavelength elements, said short-circuit element being divided into first and second segments, end portions of said first and second segments being first and second feed points, thereby T-matching the dipole antenna; and a feed line connected to said first and second feed points, said feed line being configured so that a first current flowing into said feed line from said first feed point through said first segment of said short-circuit element and said first quarter wavelength element and a second current flowing into said feed line from said second feed point through said second segment of said short-circuit element and said second quarter wavelength element are almost opposite in phase.

7. The antenna apparatus according to claim 6, wherein a part of said feed line is overlapped with said first segment of said short-circuit element.

8. The antenna apparatus according to claim 6, wherein said feed line is overlapped with one of said first and second segments of said short-circuit element and one of said first and second quarter wavelength elements and said feed line is branched at a central portion of said first and second quarter wavelength elements.

9. The antenna apparatus according to claim 6, wherein said first and second quarter wavelength elements are provided linearly in proximity to a surface of a metal housing including a radio device circuit;

said feed line is a coaxial feed line, an outer conductor of said feed line being connected to said first quarter wavelength element and said first segment of said short-circuit element, a tip end of a central conductor of said feed line being connected to said second feed point, and a tip end of said outer conductor being connected to said first feed point.

10. A radio device comprising:

the antenna apparatus according to claim 6;

a radio device circuit connected to said first and second feed points through said feed line; and a metal housing for housing said radio device circuit, said dipole antenna being arranged near a surface of said metal housing.

11. An antenna apparatus comprising:

a linear element having one end being a first feed point;

a helical element having one end near said first feed point of said linear element being a second feed point, an axial direction of the helical element crossing the linear element;

a half wavelength element connected to the other end of said helical element, a direction of the half wavelength element being coincident with the axial direction of the helical element; and a coaxial feed line provided in parallel to said linear element and connecting the first and second feed points with a radio device circuit, an outer conductor of said coaxial feed line being connected to said first feed point, and a central conductor of said coaxial feed line being connected to said second feed point, wherein said helical element comprises a portion through which current for canceling current flowing through said outer conductor of said coaxial feed line flows.

12. The antenna apparatus according to claim 11, wherein an angle between an initial winding portion of said helical element and said linear element is 0 to 90 degrees.

13. The antenna apparatus according to claim 11, wherein said helical element is configured so that a current having a phase almost opposite to a phase of a current flowing through a surface of said outer conductor, flows through said helical element.

14. The antenna apparatus according to claim 11, wherein said helical element is configured to form a radiation field canceling unnecessary radiation caused by a current flowing through a surface of said outer conductor.

15. A radio device comprising:

the antenna apparatus according to claim 11;

a radio device circuit connected to the first and second feed points through said feed line; and a metal housing configured to house said radio device circuit, wherein said dipole antenna is arranged near a surface of said metal housing.

16. An antenna apparatus comprising:

a feed line having a feed point at one end;

a linear antenna having a length of a half wavelength; and a quarter wavelength element connected between a proximal end of said linear antenna and the feed point, and having a portion through which current for canceling current flowing through the linear antenna flows.

17. The antenna apparatus according to claim 16, wherein a current flowing through said linear antenna is almost opposite in phase to a current flowing through said quarter wavelength element.

18. A radio device comprising:

the antenna apparatus according to claim 16;

a radio device circuit connected to the first and second feed points through said feed line; and a metal housing configured to house said radio device circuit, wherein said dipole antenna is arranged near a surface of said metal housing.

19. An antenna apparatus comprising:

a metal housing;

a feed line housed in said housing and having a feed point at a surface of said housing;

a linear antenna outside of said housing and having a length of a half wavelength, a first end of the antenna being positioned higher than the feed point, and a second end of the antenna being positioned lower than the feed point; and a quarter wavelength element connected between the second end of said linear antenna and the feed point.

20. The antenna according to claim 19, wherein said feed point is located at a top surface of said housing and the second end of said linear antenna is located below the top surface of said housing.

* * * * *